US011827483B2

(12) United States Patent
Tsai

(10) Patent No.: US 11,827,483 B2
(45) Date of Patent: Nov. 28, 2023

(54) MEDIUM PASSAGE SWITCHING MECHANISM AND RELATED IMAGE FORMING DEVICE

(71) Applicant: AVISION INC., Hsinchu (TW)

(72) Inventor: Wei-Lun Tsai, Hsinchu (TW)

(73) Assignee: AVISION INC., Hsinchu (TW)

( * ) Notice: Subject to any disclaimer, the term of this patent is extended or adjusted under 35 U.S.C. 154(b) by 228 days.

(21) Appl. No.: 17/472,713

(22) Filed: Sep. 13, 2021

(65) Prior Publication Data

US 2022/0177243 A1 Jun. 9, 2022

(30) Foreign Application Priority Data

Dec. 4, 2020 (TW) ..... 109142796

(51) Int. Cl.
*B65H 5/36* (2006.01)
*B65H 1/26* (2006.01)
*B65H 5/26* (2006.01)

(52) U.S. Cl.
CPC ..... *B65H 5/36* (2013.01); *B65H 1/26* (2013.01); *B65H 5/26* (2013.01)

(58) Field of Classification Search
CPC ... B65H 5/36; B65H 5/26; B65H 1/26; B65H 2402/45
See application file for complete search history.

(56) References Cited

U.S. PATENT DOCUMENTS 5,708,954 A * 1/1998 Ando ..... G03G 15/234 399/401
2005/0225594 A1* 10/2005 Isono ..... B41J 13/0027 347/37
2015/0274473 A1* 10/2015 Miwa ..... B65H 31/02 271/189
2019/0224977 A1 7/2019 Ueda

FOREIGN PATENT DOCUMENTS

TW 399527 7/2000
TW M299984 10/2006
TW 201100260 A1 1/2011
TW 201946794 A 12/2019

* cited by examiner

*Primary Examiner* — Jennifer Bahls
(74) *Attorney, Agent, or Firm* — Winston Hsu

(57) ABSTRACT

A medium passage switching mechanism disposed on a casing of an image forming device, includes a medium tray, a guiding component and a linking component. An entrance passage, a first exit passage and a second exit passage are formed inside the casing. The medium tray is pivoted to the casing. The guiding component is pivoted to the casing. The linking component is a one-piece structure and movably connected to the medium tray and the guiding component. When the medium tray pivots relative to the casing, the medium tray drives the linking component to drive the guiding component to pivot relative to the casing, so that the guiding component can guide a medium to enter into the first exit passage or the second exit passage selectively from the entrance passage.

20 Claims, 9 Drawing Sheets

MEDIUM PASSAGE SWITCHING MECHANISM AND RELATED IMAGE FORMING DEVICE

BACKGROUND OF THE DISCLOSURE

1. Field of the Disclosure

The present invention relates to a medium passage switching mechanism and a related image forming device, and more specifically, to a medium passage switching mechanism which can guide different media to enter into different exit passages selectively, and a related image forming device.

2. Description of the Prior Art

Image forming devices, such as scanners and printers, are widely used in homes or offices for bringing convenience in people's lives. In order to capture images of different types of scanned media, such as paper or cards, or to form images on different types of printed media, such as paper or cards, an image forming device is usually provided with multiple passages and a switching mechanism, so that a user can operate the switching mechanism according to a type of a scanned medium or a type of a printed medium, so as to guide the medium to enter into a proper passage, which prevents the scanned medium or the printed medium from being stuck in the image forming device due to entry of an improper passage. However, the conventional switching mechanism has a complicated structure and difficult operation. Therefore, there is a need to provide an improved switching mechanism.

SUMMARY OF THE DISCLOSURE

It is an objective of the present invention to provide a medium passage switching mechanism disposed on a casing of an image forming device, and a related image forming device for solving the aforementioned problem.

In order to achieve the aforementioned objective, the present invention discloses a medium passage switching mechanism disposed on a casing of an image forming device. An entrance passage, a first exit passage and a second exit passage are formed in the casing. The medium passage switching mechanism includes a medium tray, a guiding component and a linking component. The medium tray is pivoted to the casing and pivotally switchable between a first position and a second position. The guiding component is pivoted to the casing and pivotally switchable between a third position and a fourth position. The linking component is movably connected to the medium tray and the guiding component. The linking component is a one-piece structure. The medium tray drives the linking component to drive the guiding component to pivot relative to the casing from the third position to the fourth position along a first pivoting direction when the medium tray is pivoted relative to the casing from the first position to the second position along the first pivoting direction. The guiding component guides a medium to enter into the second exit passage from the entrance passage when the guiding component is located at the fourth position. The medium tray drives the linking component to drive the guiding component to pivot relative to the casing from the fourth position to the third position along a second pivoting direction opposite to the first pivoting direction when the medium tray is pivoted relative to the casing from the second position to the first position along the second pivoting direction, and the guiding component guides the medium to enter into the first exit passage from the entrance passage when the guiding component is located at the third position.

According to an embodiment of the present invention, the linking component is a torsional spring. The linking component includes a first connecting portion and a second connecting portion, and the first connecting portion and the second connecting portion are respectively movably connected to the guiding component and the medium tray.

According to an embodiment of the present invention, the medium tray includes a tray pivoting portion and a tray connecting portion. The tray pivoting portion is pivoted to the casing, and the tray connecting portion is offset from the tray pivoting portion and movably connected to the second connecting portion of the linking component.

According to an embodiment of the present invention, the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

According to an embodiment of the present invention, the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

According to an embodiment of the present invention, the guiding component includes a guiding pivoting portion and a guiding connecting portion. The guiding pivoting portion is pivoted to the casing, and the guiding connecting portion is movably connected to the first connecting portion of the linking component.

According to an embodiment of the present invention, the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

According to an embodiment of the present invention, the medium tray includes at least one engaging portion, and the at least one engaging portion engages with at least one cooperating portion formed on the casing when the medium tray is pivoted to the first position.

According to an embodiment of the present invention, the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

According to an embodiment of the present invention, the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

In order to achieve the aforementioned objective, the present invention further discloses an image forming device. The image forming device includes a casing and a medium passage switching mechanism. An entrance passage, a first exit passage and a second exit passage are formed in the casing. The medium passage switching mechanism is disposed on the casing and for guiding a medium to enter into the first exit passage or the second exit passage from the entrance passage. The medium passage switching mechanism includes a medium tray, a guiding component and a linking component. The medium tray is pivoted to the casing and pivotally switchable between a first position and a second position. The guiding component is pivoted to the casing and pivotally switchable between a third position and a fourth position. The linking component is movably connected to the medium tray and the guiding component. The linking component is a one-piece structure. The medium tray drives the linking component to drive the guiding component to pivot relative to the casing from the third position to the fourth position along a first pivoting direction when the medium tray is pivoted relative to the casing from the first position to the second position along the first pivoting direction. The guiding component guides the medium to enter into the second exit passage from the entrance passage when the guiding component is located at the fourth position. The medium tray drives the linking component to drive the guiding component to pivot relative to the casing from the fourth position to the third position along a second pivoting direction opposite to the first pivoting direction when the medium tray is pivoted relative to the casing from the second position to the first position along the second pivoting direction, and the guiding component guides the medium to enter into the first exit passage from the entrance passage when the guiding component is located at the third position.

According to an embodiment of the present invention, the linking component is a torsional spring. The linking component includes a first connecting portion and a second connecting portion, and the first connecting portion and the second connecting portion are respectively movably connected to the guiding component and the medium tray.

According to an embodiment of the present invention, the medium tray includes a tray pivoting portion and a tray connecting portion. The tray pivoting portion is pivoted to the casing, and the tray connecting portion is offset from the tray pivoting portion and movably connected to the second connecting portion of the linking component.

According to an embodiment of the present invention, the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

According to an embodiment of the present invention, the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

According to an embodiment of the present invention, the guiding component includes a guiding pivoting portion and a guiding connecting portion. The guiding pivoting portion is pivoted to the casing, and the guiding connecting portion is movably connected to the first connecting portion of the linking component.

According to an embodiment of the present invention, the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

According to an embodiment of the present invention, the medium tray includes at least one engaging portion. At least one cooperating portion is formed on the casing, and the at least one engaging portion engages with the at least one cooperating portion when the medium tray is pivoted to the first position.

According to an embodiment of the present invention, the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

According to an embodiment of the present invention, the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

In summary, in the present invention, the linking component movably connected to the medium tray and the guiding component is the one-piece structure, and the medium tray drives the linking component to drive the guiding component to pivot relative to the casing to selectively guide the medium to enter into the first exit passage or the second exit passage from the entrance passage. Therefore, the present invention has advantages of simple structure and easy operation.

These and other objectives of the present disclosure will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "front", "back", etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, the term "connect" or "pivot" is intended to mean either an indirect or direct mechanical connection. Thus, if a first device is connected or pivoted to a second device, that connection may be through a direct mechanical connection, or through an indirect mechanical connection via other devices and connections.

Figure 1:
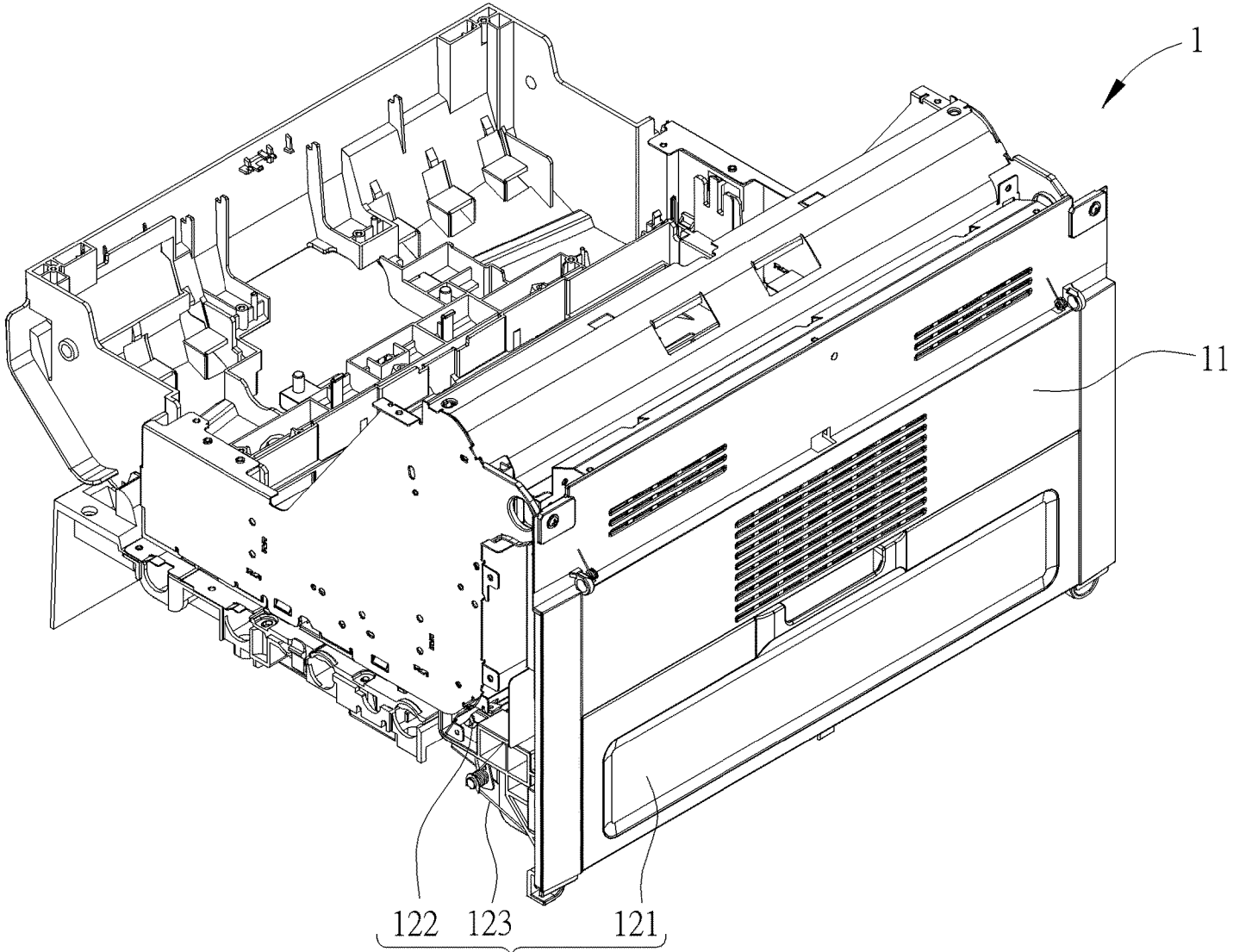
FIG. 1 and FIG. 2 are partial structural diagrams of an image forming device at different views according to an embodiment of the present invention.
Figure 2:
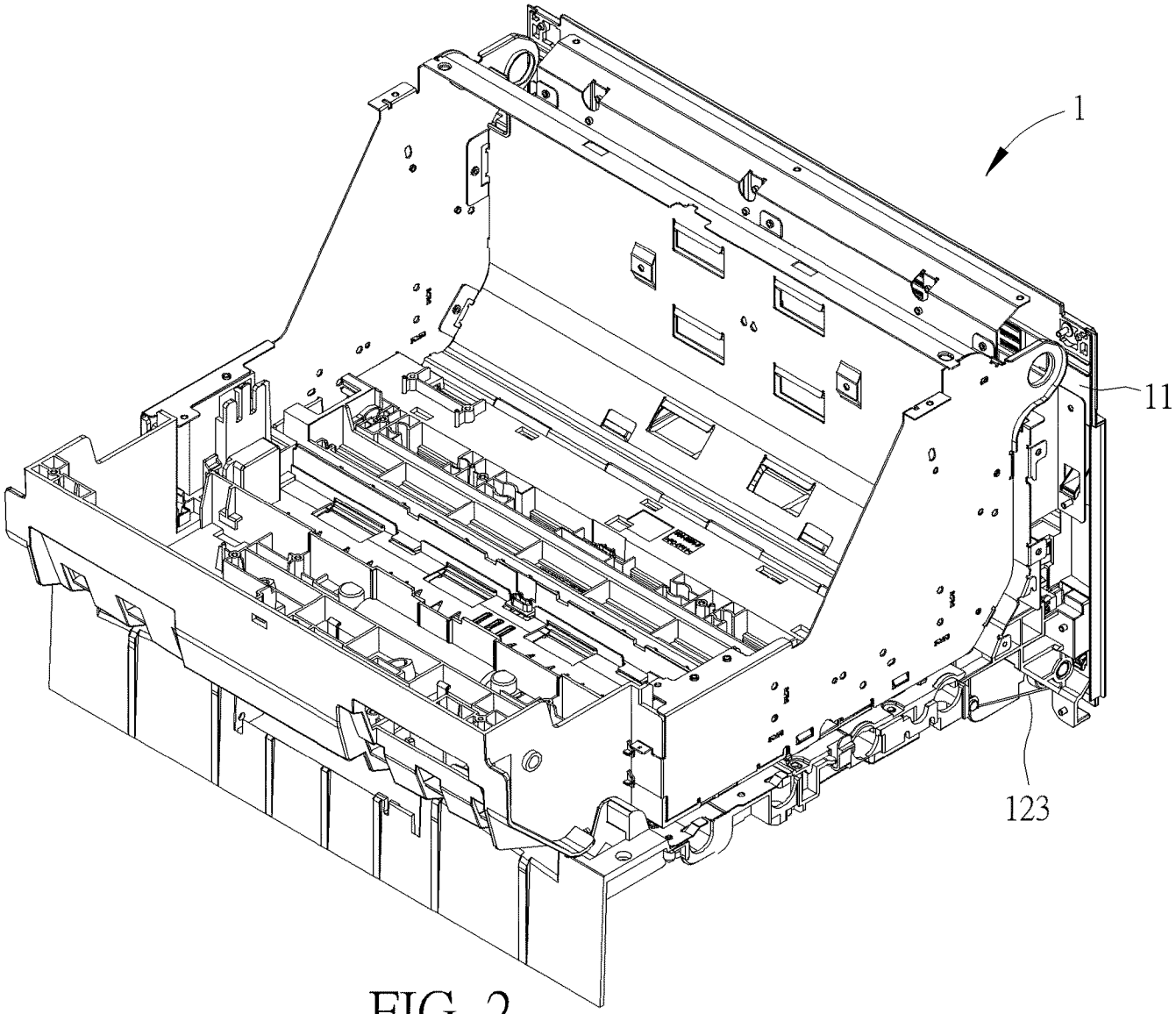
Figure 3:
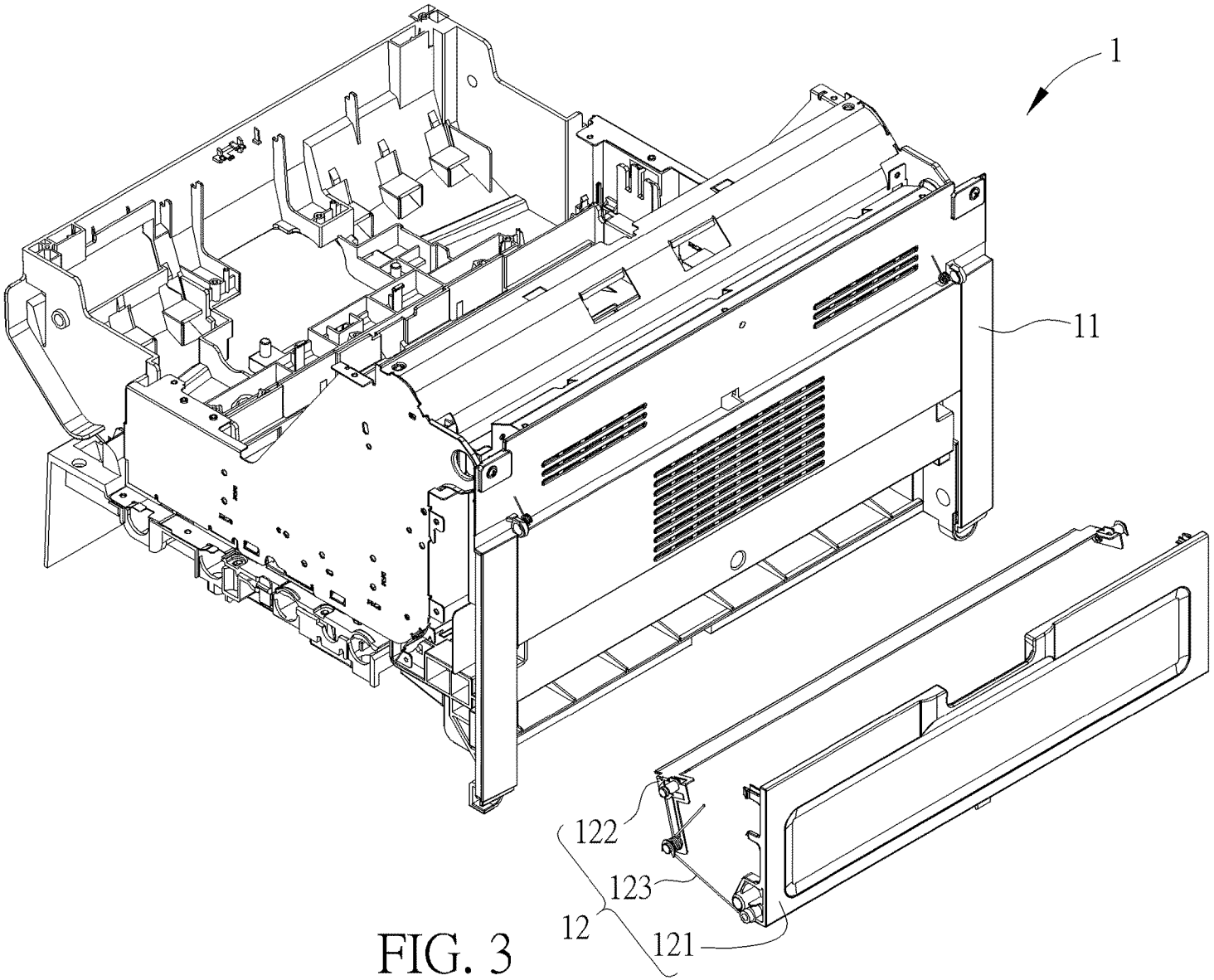
FIG. 3 is a partial exploded diagram of the image forming device according to the embodiment of the present invention.
Figure 4:
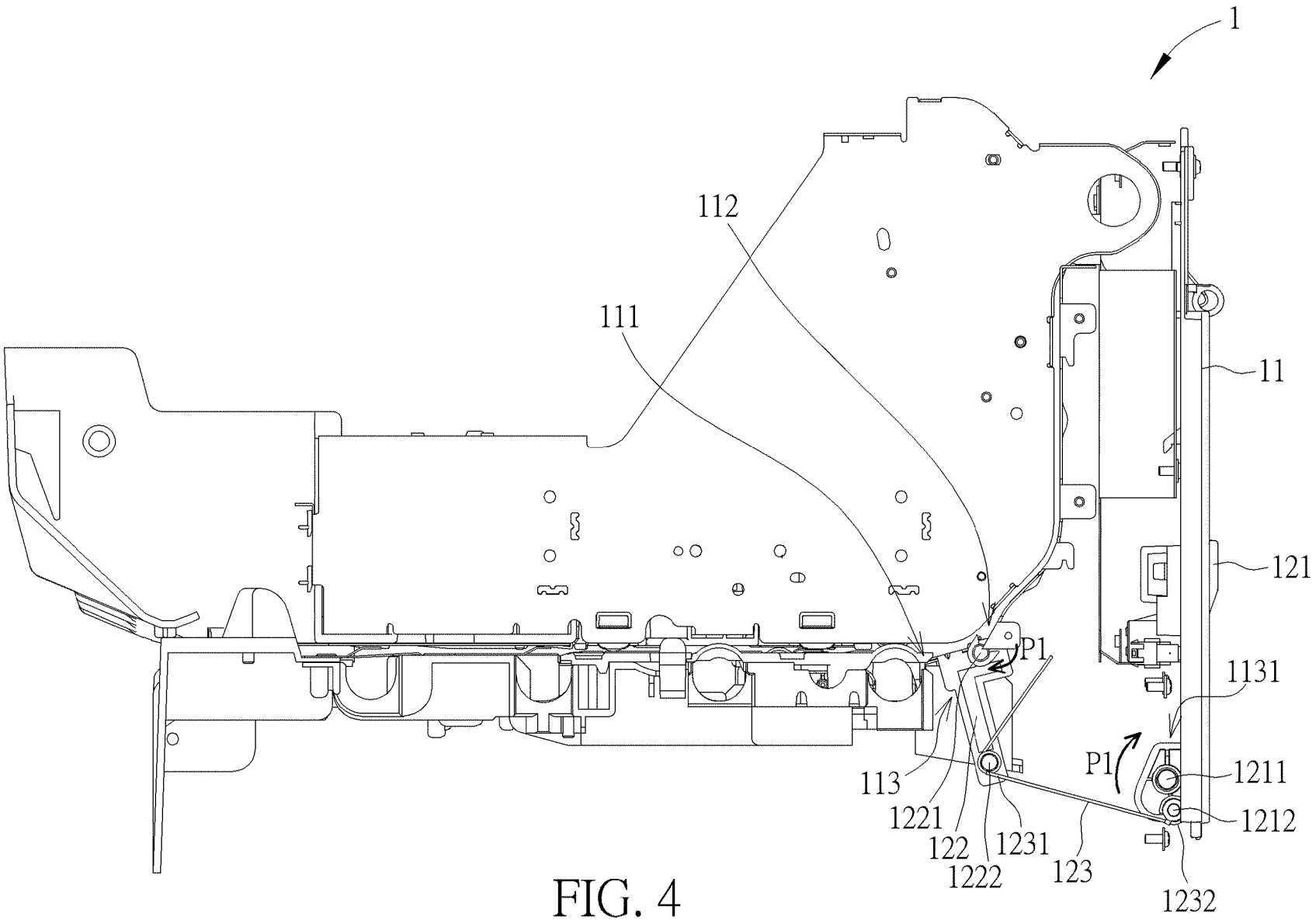
FIG. 4 is a partial structural diagram of the image forming device in a first state according to the embodiment of the present invention.
Figure 5:
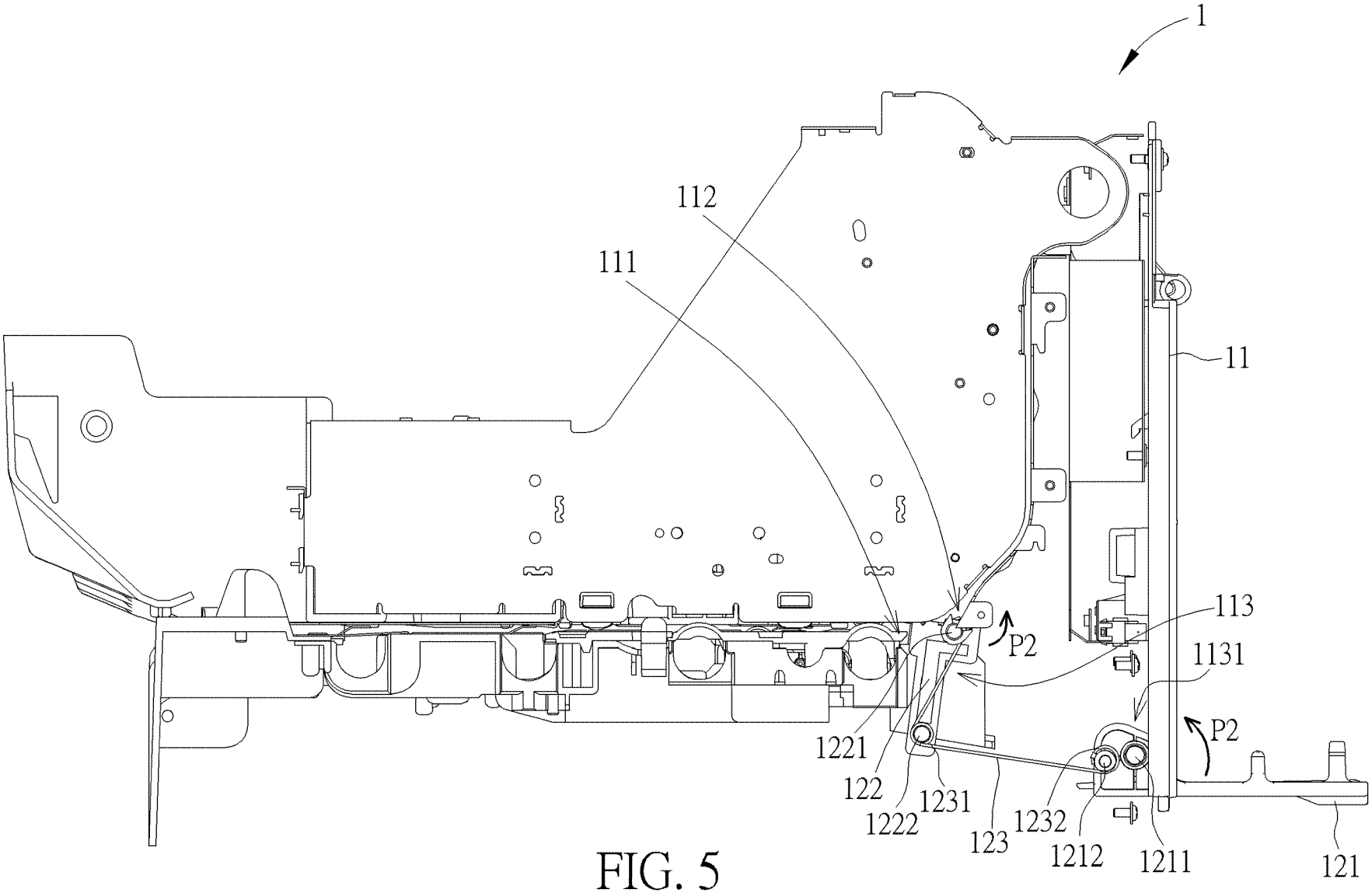
FIG. 5 is a partial structural diagram of the image forming device in a second state according to the embodiment of the present invention.

Please refer to FIG. 1 to FIG. 5. FIG. 1 and FIG. 2 are partial structural diagrams of an image forming device 1 at different views according to an embodiment of the present invention. FIG. 3 is a partial exploded diagram of the image forming device 1 according to the embodiment of the present invention. FIG. 4 is a partial structural diagram of the image forming device 1 in a first state according to the embodiment of the present invention. FIG. 5 is a partial structural diagram of the image forming device 1 in a second state according to the embodiment of the present invention. As shown in FIG. 1 to FIG. 5, the image forming device 1 includes a casing 11 and a medium passage switching mechanism 12. An entrance passage 111, a first exit passage 112 and a second exit passage 113 are formed in the casing 11. The entrance passage 111 is communicated with the first exit passage 112 and the second exit passage 113. The medium passage switching mechanism 12 is disposed on the casing 11 and for guiding a medium, such as a sheet of paper, a photograph or a card, to enter into the first exit passage 112 or the second exit passage 113 from the entrance passage 111. For example, when the medium is a sheet of paper which is soft, the medium passage switching mechanism 12 can be operated to be in the first state as shown in FIG. 4 for guiding the medium to enter into the first exit passage 112 from the entrance passage 111. When the medium is a card which is hard, the medium passage switching mechanism 12 can be operated to be in the second state as shown in FIG. 5 for guiding the medium to enter into the second exit passage 113 from the entrance passage 111.

The medium passage switching mechanism 12 includes a medium tray 121, a guiding component 122 and a linking component 123. The medium tray 121 is pivoted to the casing 11 and adjacent to an exit end 1131 of the second exit passage 113 away from the entrance passage 111. The medium tray 121 can be pivotally switched between a first position as shown in FIG. 4 and a second position as shown in FIG. 5, wherein a pivotal movement of the medium tray 121 can be driven manually by a user or driven by an electric motor or any other mechanism. The guiding component 122 is pivoted to the casing 11 and adjacent to where the entrance passage 111 is communicated with the first exit passage 112 and the second exit passage 113. The guiding component 122 can be pivotally switched between a third position as shown in FIG. 4 and a fourth position as shown in FIG. 5. The linking component 123 is movably connected to the medium tray 121 and the guiding component 122. The linking component 123 is a one-piece structure. When the medium tray 121 is pivotally switched between the first position as shown in FIG. 4 and the second position as shown in FIG. 5, the medium tray 121 drives the linking component 123 to drive the guiding component 122 to pivotally switch relative to the casing 11 between the third position as shown in FIG. 4 and the fourth position as shown in FIG. 5 for guiding the medium to enter into the first exit passage 112 or the second exit passage 113 from the entrance passage 111.

Specifically, in order to drive the linking component 123 by the medium tray 121 to drive the guiding component 122 to pivot relative to the casing 11 when the medium tray 121 pivots relative to the casing 11, as shown in FIG. 4 and FIG. 5, in this embodiment, the linking component 123 can be a torsional spring. The linking component 123 includes a first connecting portion 1231 and a second connecting portion 1232. The first connecting portion 1231 is located at a central portion of the linking component 123. The second connecting portion 1232 is located at one end of the linking component 123. The first connecting portion 1231 and the second connecting portion 1232 are respectively movably connected to the guiding component 122 and the medium tray 121.

Furthermore, the medium tray 121 includes a tray pivoting portion 1211 and a tray connecting portion 1212. The tray pivoting portion 1211 is pivoted to the casing 11. The tray connecting portion 1212 is offset from the tray pivoting portion 1211 and movably connected to the second connecting portion 1232 of the linking component 123.

In addition, the guiding component 122 includes a guiding pivoting portion 1221 and a guiding connecting portion 1222. The guiding pivoting portion 1221 is pivoted to the casing 11. The guiding connecting portion 1222 is movably connected to the first connecting portion 1231 of the linking component 123.

Figure 6:
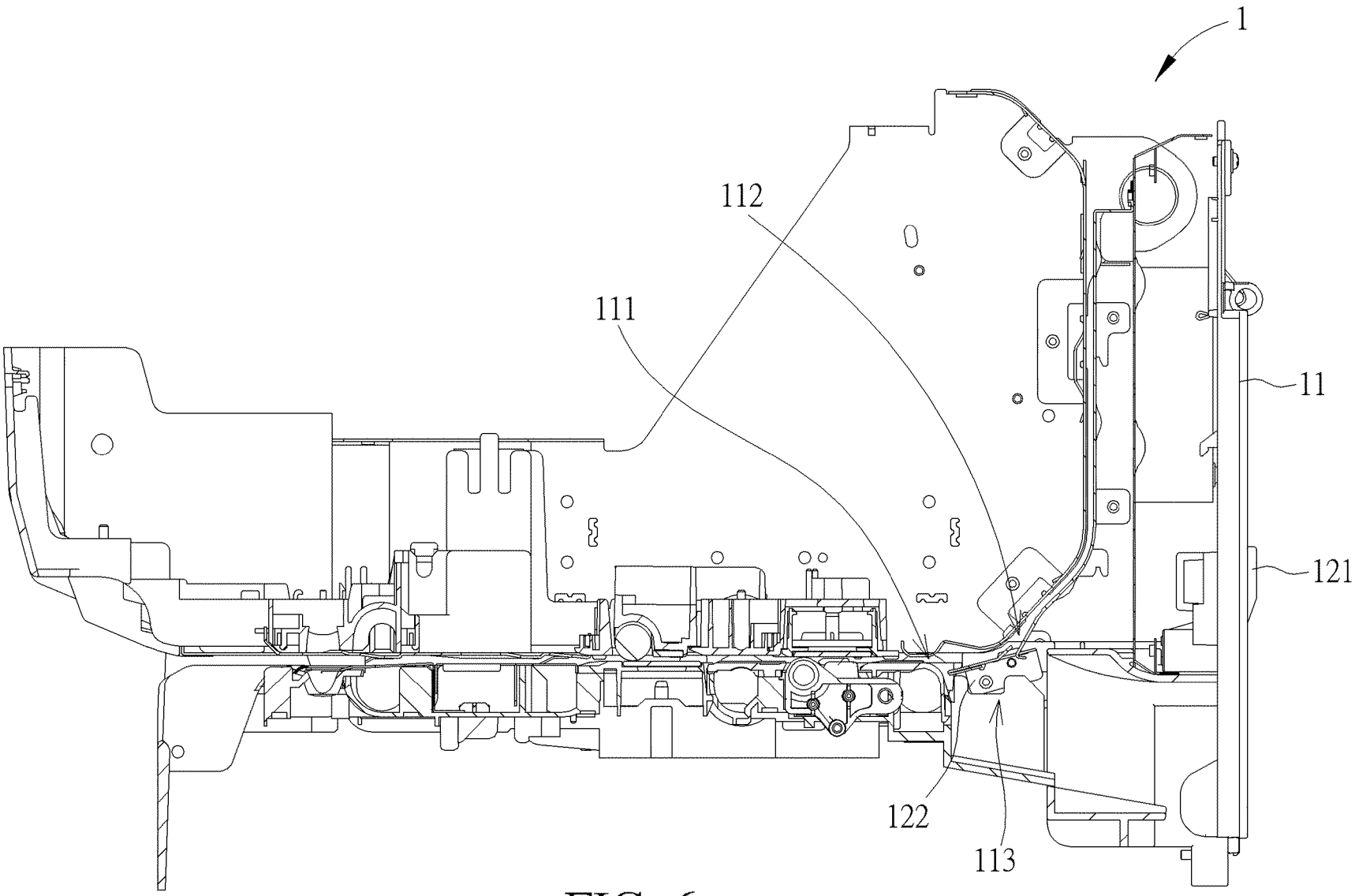
FIG. 6 is a partial sectional diagram of the image forming device in the first state according to the embodiment of the present invention.
Figure 7:
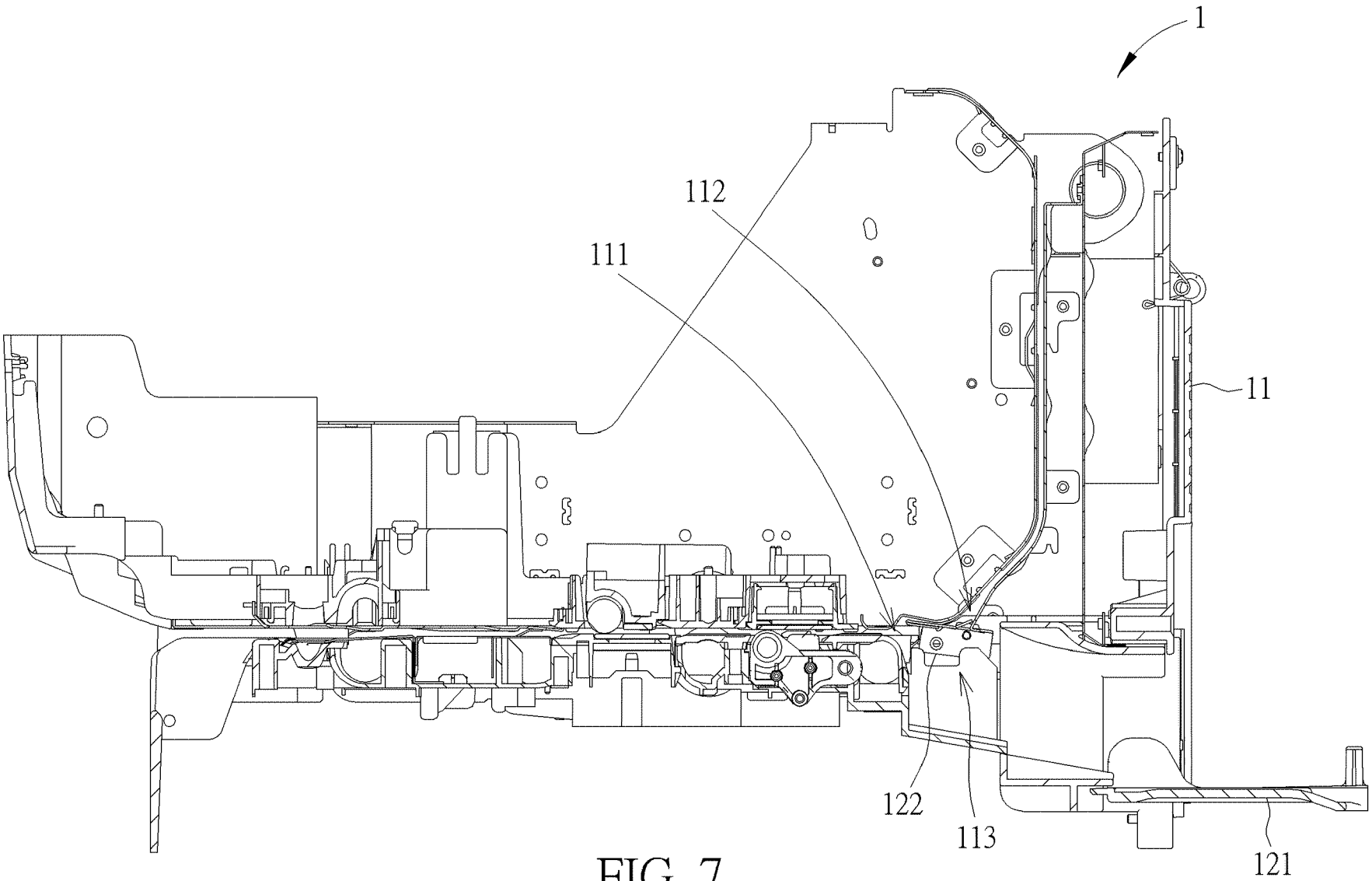
FIG. 7 is a partial sectional diagram of the image forming device in the second state according to the embodiment of the present invention.

Please refer to FIG. 4 to FIG. 7. FIG. 6 is a partial sectional diagram of the image forming device 1 in the first state according to the embodiment of the present invention. FIG. 7 is a partial sectional diagram of the image forming device 1 in the second state according to the embodiment of the present invention. When the medium is made of hard material, such as the card, the medium tray 121 can be operated to pivot relative to the casing 11 from the first position as shown in FIG. 4 to the second position as shown in FIG. 5 along a first pivoting direction P1, i.e., along a clockwise direction. When the medium tray 121 pivots relative to the casing 11 from the first position as shown in FIG. 4 to the second position as shown in FIG. 5 along the first pivoting direction P1, the medium tray 121 drives the linking component 123 to drive the guiding component 122 to pivot relative to the casing 11 from the third position as shown in FIG. 4 to the fourth position as shown in FIG. 5 along the first pivoting direction P1. As shown in FIG. 5 and FIG. 7, when the guiding component 122 is located at the fourth position, the guiding component 122 conceals the first exit passage 112 but not conceals the second exit passage 113. Therefore, the guiding component 122 can guide the medium to enter into the second exit passage 113 from the entrance passage 111 when the guiding component 122 is located at the fourth position.

When the medium is made of soft material, such as the sheet of paper, the medium tray 121 can be operated to pivot relative to the casing 11 from the second position as shown in FIG. 5 to the first position as shown in FIG. 4 along a second pivoting direction P2 opposite to the first pivoting direction P1, i.e., along a counterclockwise direction. When the medium tray 121 pivots relative to the casing 11 from the second position as shown in FIG. 5 to the first position as shown in FIG. 4 along the second pivoting direction P2, the medium tray 121 drives the linking component 123 to drive the guiding component 122 to pivot relative to the casing 11 from the fourth position as shown in FIG. 5 to the third position as shown in FIG. 4 along the second pivoting direction P2. As shown in FIG. 4 and FIG. 6, when the guiding component 122 is located at the third position, the guiding component 122 conceals the second exit passage 113 but not conceals the first exit passage 112. Therefore, the guiding component 122 can guide the medium to enter into the first exit passage 112 from the entrance passage 111 when the guiding component 122 is located at the third position.

Figure 8:
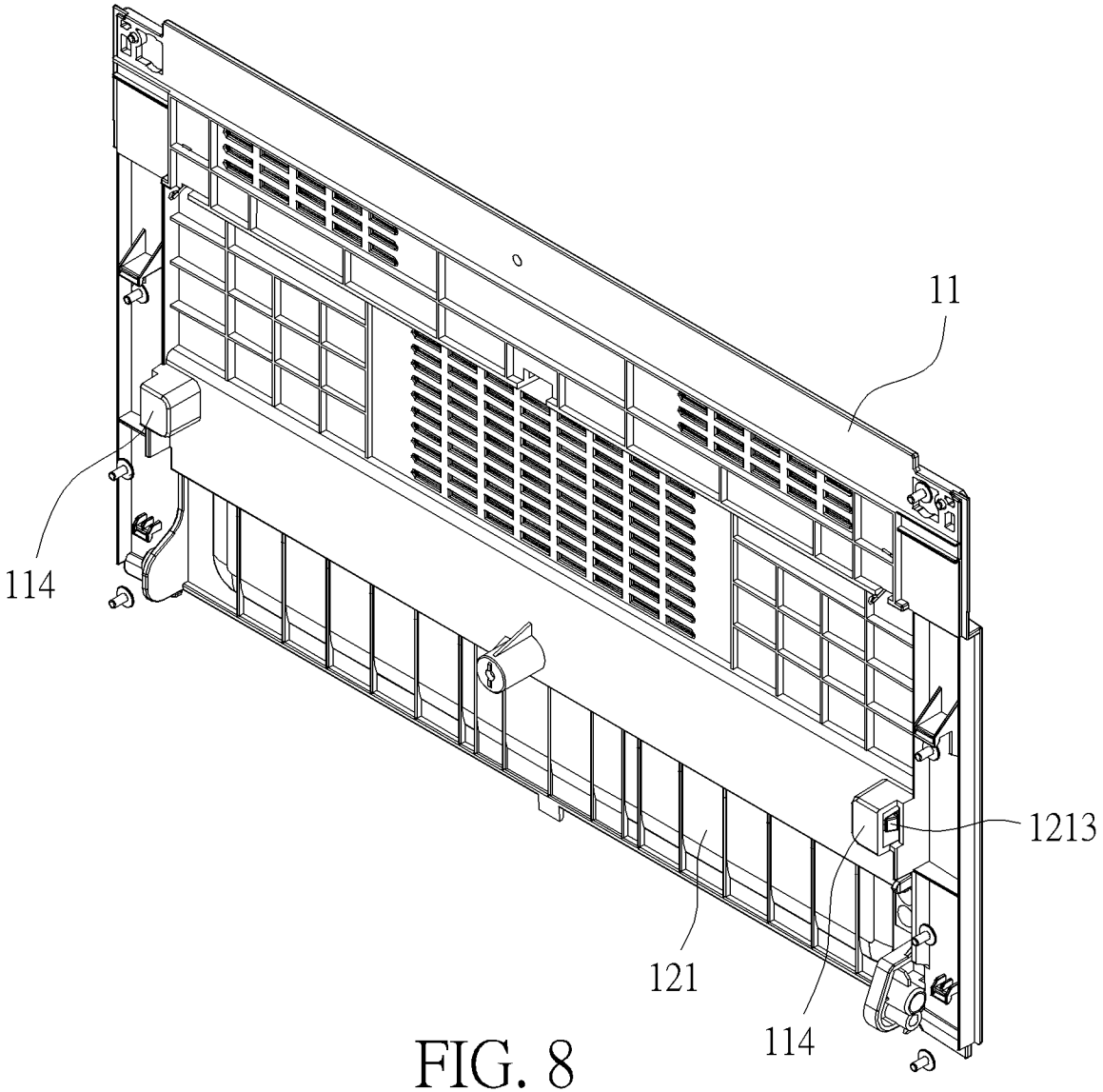
FIG. 8 is a structural diagram of apart of a casing and a medium tray at a first position according to the embodiment of the present invention.
Figure 9:
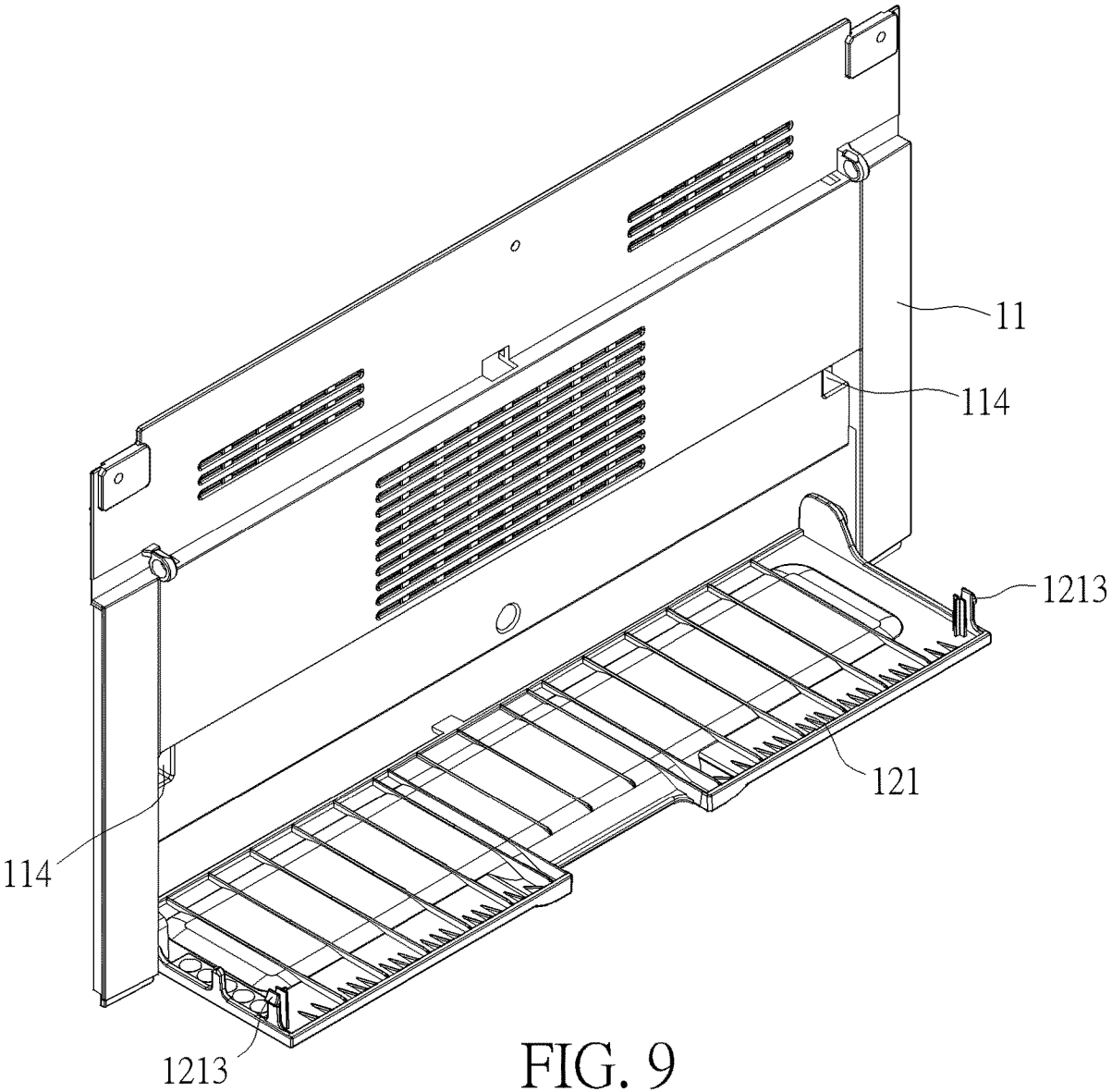
FIG. 9 is a structural diagram of a part of the casing and the medium tray at a second position according to the embodiment of the present invention.

Please further refer to FIG. 4, FIG. 5, FIG. 8 and FIG. 9. FIG. 8 is a structural diagram of a part of the casing 11 and the medium tray 121 at the first position according to the embodiment of the present invention. FIG. 9 is a structural diagram of a part of the casing 11 and the medium tray 121 at the second position according to the embodiment of the present invention. As shown in FIG. 4, FIG. 5, FIG. 8 and FIG. 9, in this embodiment, the linking component 123 is the torsional spring. When the medium tray 121 and the guiding component 122 are respectively located at the first position and the third position as shown in FIG. 4, the linking component 123 can be resiliently deformed to generate a resilient force for driving the medium tray 121 and the guiding component 122 to depart from the first position and the third position respectively. In order to prevent the medium tray 121 and the guiding component 122 from departing from the first position and the third position respectively by the resilient force, the medium tray 121 includes two engaging portions 1213, and two cooperating portions 114 are formed on the casing 11. When the medium tray 121 is pivoted to the first position, each of the two engaging portions 1213 can be engaged with a corresponding one of the two cooperating portions 114 for positioning the medium tray 121 and the guiding component 122 at the first position and the third position respectively. Furthermore, the medium tray 121 and the guiding component 122 can be driven by the resilient force to depart from the first position and the third position respectively, e.g., to the second position and the fourth position respectively, when the two engaging portions 121 of the medium tray 121 are not engaged with the two cooperating portions 114 formed on the casing 11.

In this embodiment, preferably, each of the two engaging portions 1213 can be an engaging hook, and each of the two cooperating portions 114 can be an engaging notch. However, the structural configuration and the number of the engaging portion and the cooperating portion are not limited to this embodiment. For example, in another embodiment, the medium tray can include only one engaging portion, and there can be only one cooperating portion formed on the casing, wherein the engaging portion and the cooperating portion can be an engaging notch and an engaging hook respectively. Alternatively, in another embodiment, when the resilient force generated by the linking component can be overcome by any other mechanism, e.g., a frictional force, the engaging portion and the cooperating portion can be omitted.

In contrast to the prior art, in the present invention, the linking component movably connected to the medium tray and the guiding component is the one-piece structure, and the medium tray drives the linking component to drive the guiding component to pivot relative to the casing to selectively guide the medium to enter into the first exit passage or the second exit passage from the entrance passage. Therefore, the present invention has advantages of simple structure and easy operation.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A medium passage switching mechanism disposed on a casing of an image forming device, an entrance passage, a first exit passage and a second exit passage being formed in the casing, the medium passage switching mechanism comprising:

a medium tray pivoted to the casing and pivotally switchable between a first position and a second position;

a guiding component pivoted to the casing and pivotally switchable between a third position and a fourth position; and a linking component movably connected to the medium tray and the guiding component, the linking component being a one-piece structure;

wherein the medium tray drives the linking component to drive the guiding component to pivot relative to the casing from the third position to the fourth position along a first pivoting direction when the medium tray is pivoted relative to the casing from the first position to the second position along the first pivoting direction, the guiding component guides a medium to enter into the second exit passage from the entrance passage when the guiding component is located at the fourth position, the medium tray drives the linking component to drive the guiding component to pivot relative to the casing from the fourth position to the third position along a second pivoting direction opposite to the first pivoting direction when the medium tray is pivoted relative to the casing from the second position to the first position along the second pivoting direction, and the guiding component guides the medium to enter into the first exit passage from the entrance passage when the guiding component is located at the third position.

2. The medium passage switching mechanism of claim 1, wherein the linking component is a torsional spring, the linking component comprises a first connecting portion and a second connecting portion, and the first connecting portion and the second connecting portion are respectively movably connected to the guiding component and the medium tray.

3. The medium passage switching mechanism of claim 2, wherein the medium tray comprises a tray pivoting portion and a tray connecting portion, the tray pivoting portion is pivoted to the casing, and the tray connecting portion is offset from the tray pivoting portion and movably connected to the second connecting portion of the linking component.

4. The medium passage switching mechanism of claim 3, wherein the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

5. The medium passage switching mechanism of claim 2, wherein the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

6. The medium passage switching mechanism of claim 2, wherein the guiding component comprises a guiding pivoting portion and a guiding connecting portion, the guiding pivoting portion is pivoted to the casing, and the guiding connecting portion is movably connected to the first connecting portion of the linking component.

7. The medium passage switching mechanism of claim 6, wherein the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

8. The medium passage switching mechanism of claim 1, wherein the medium tray comprises at least one engaging portion, and the at least one engaging portion engages with at least one cooperating portion formed on the casing when the medium tray is pivoted to the first position.

9. The medium passage switching mechanism of claim 8, wherein the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

10. The medium passage switching mechanism of claim 1, wherein the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

11. An image forming device comprising:

a casing, an entrance passage, a first exit passage and a second exit passage being formed in the casing; and a medium passage switching mechanism disposed on the casing and for guiding a medium to enter into the first exit passage or the second exit passage from the entrance passage, the medium passage switching mechanism comprising:

a medium tray pivoted to the casing and pivotally switchable between a first position and a second position;

a guiding component pivoted to the casing and pivotally switchable between a third position and a fourth position; and a linking component movably connected to the medium tray and the guiding component, the linking component being a one-piece structure;

wherein the medium tray drives the linking component to drive the guiding component to pivot relative to the casing from the third position to the fourth position along a first pivoting direction when the medium tray is pivoted relative to the casing from the first position to the second position along the first pivoting direction, the guiding component guides the medium to enter into the second exit passage from the entrance passage when the guiding component is located at the fourth position, the medium tray drives the linking component to drive the guiding component to pivot relative to the casing from the fourth position to the third position along a second pivoting direction opposite to the first pivoting direction when the medium tray is pivoted relative to the casing from the second position to the first position along the second pivoting direction, and the guiding component guides the medium to enter into the first exit passage from the entrance passage when the guiding component is located at the third position.

12. The image forming device of claim 11, wherein the linking component is a torsional spring, the linking component comprises a first connecting portion and a second connecting portion, and the first connecting portion and the second connecting portion are respectively movably connected to the guiding component and the medium tray.

13. The image forming device of claim 12, wherein the medium tray comprises a tray pivoting portion and a tray connecting portion, the tray pivoting portion is pivoted to the casing, and the tray connecting portion is offset from the tray pivoting portion and movably connected to the second connecting portion of the linking component.

14. The image forming device of claim 13, wherein the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

15. The image forming device of claim 12, wherein the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

16. The image forming device of claim 12, wherein the guiding component comprises a guiding pivoting portion and a guiding connecting portion, the guiding pivoting portion is pivoted to the casing, and the guiding connecting portion is movably connected to the first connecting portion of the linking component.

17. The image forming device of claim 16, wherein the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

18. The image forming device of claim 11, wherein the medium tray comprises at least one engaging portion, at least one cooperating portion is formed on the casing, and the at least one engaging portion engages with the at least one cooperating portion when the medium tray is pivoted to the first position.

19. The image forming device of claim 18, wherein the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

20. The image forming device of claim 11, wherein the guiding component conceals the second exit passage but not conceals the first exit passage for guiding the medium to enter into the first exit passage from the entrance passage when the guiding component is located at the third position, and the guiding component conceals the first exit passage but not conceals the second exit passage for guiding the medium to enter into the second exit passage from the entrance passage when the guiding component is located at the fourth position.

* * * * *